US007328582B2

(12) United States Patent
Sandelis et al.

(10) Patent No.: US 7,328,582 B2
(45) Date of Patent: Feb. 12, 2008

(54) ANNULAR COMBUSTION CHAMBER FOR A TURBOMACHINE

(75) Inventors: Denis Sandelis, Nangis (FR); Yves Salan, Champcueil (FR)

(73) Assignee: Snecma Moteurs, Paris (FR)

( * ) Notice: Subject to any disclaimer, the term of this patent is extended or adjusted under 35 U.S.C. 154(b) by 342 days.

(21) Appl. No.: 10/529,583

(22) PCT Filed: Jun. 18, 2004

(86) PCT No.: PCT/FR2004/050281

§ 371 (c)(1),
(2), (4) Date: Mar. 29, 2005

(87) PCT Pub. No.: WO2004/113794

PCT Pub. Date: Dec. 29, 2004

(65) Prior Publication Data

US 2007/0056289 A1 Mar. 15, 2007

(30) Foreign Application Priority Data

Jun. 18, 2003 (FR) ..... 03 50232

(51) Int. Cl.
*F23R 3/04* (2006.01)

(52) U.S. Cl. ..... 60/804; 60/752

(58) Field of Classification Search ..... 60/722, 60/752, 754, 755, 757, 804
See application file for complete search history.

(56) References Cited

U.S. PATENT DOCUMENTS

| | | | | |
|---|---|---|---|---|
| 5,307,637 | A | 5/1994 | Stickles et al. | |
| 5,918,467 | A | 7/1999 | Kwan | |
| 5,941,076 | A * | 8/1999 | Sandelis | 60/752 |
| 6,155,056 | A | 12/2000 | Sampath et al. | |
| 6,546,733 | B2 * | 4/2003 | North et al. | 60/772 |
| 6,751,961 | B2 * | 6/2004 | Pacheco-Tougas et al. | 60/752 |

FOREIGN PATENT DOCUMENTS

DE 101 58 548 6/2003

* cited by examiner

*Primary Examiner*—L. J. Casaregola
(74) *Attorney, Agent, or Firm*—Oblon, Spivak, McClelland, Maier & Neustadt, P.C.

(57) ABSTRACT

An annular turbine engine combustion chamber configured so that in an axial half-section, values of first acute angles formed between a line that is effectively the median of the half-section located between an external axial wall and an internal axial wall, and the principal directions, in this half-section, of the holes in an external portion of a chamber base, decrease as a function of the distance between the holes and this line that is effectively the median. Further, values of second acute angles formed between the line that is effectively the median and the principal directions, in this half-section, of the holes in an internal portion of the chamber base, decrease as a function of the distance between the holes and this line that is effectively the median.

6 Claims, 4 Drawing Sheets

ANNULAR COMBUSTION CHAMBER FOR A TURBOMACHINE

TECHNICAL FIELD

The present invention relates in general terms to the field of annular turbine engine combustion chambers, and more specifically to the means used to protect these combustion chambers at high temperatures.

THE EXISTING TECHNICAL ART

An annular turbine engine combustion chamber typically includes an external axial wall and an internal axial wall, with these walls being arranged coaxially and connected together by a chamber base.

At this chamber base, which is also annular in shape, the combustion chamber is fitted with injection ports that are spaced at angles, with each of these being designed to hold a fuel injector in order to allow combustion reactions to take place on the interior of this combustion chamber. It should also be noted that these injectors can also be used to introduce at least part of the air to be used for combustion with this combustion occurring in a primary zone of the combustion chamber which is located before a secondary zone referred to as the dilution zone.

In this respect it should be noted that apart from the air that is needed to carry out the combustion reactions inside the primary zone of the combustion chamber, there is also a requirement for air for dilution, which is generally introduced through dilution ports made in the internal and external axial walls, as well as cooling air to protect all the constituent components of the combustion chamber.

In one existing configuration deflectors are arranged on the chamber base with the aim of protecting it from heat radiation. Each deflector (also referred to as the cap or thermal screen) therefore has one or more injection ports designed to receive a fuel injector, as well as a series of holes which allow air to pass inside the combustion chamber.

The addition of such deflectors, however, results in several major disadvantages. Amongst these disadvantages is the fact that a large volume air supply must be admitted in order to cool these deflectors. In such a case, the cooling air supply which passes through the holes that are provided is then evacuated in the form of an equally high volume "sub deflector flow" which produces stagnation effects at the wall which manifest themselves through the creation of CO- and CH-type species. A consequence of this is that appearance of such species inside the combustion chamber results in a significant decrease in combustion efficiency.

On the other hand, it is also indicated that a direct result of the presence of deflectors is the creation of a steep thermal gradient between the cold and hot parts of the chamber, as well as a highly detrimental increase in the total mass of the combustion chamber.

In an attempt to confront these problems, another type of combustion chamber has been proposed in which the deflectors are absent. Thus the injection ports are made directly in the chamber base, in the same way as the holes, whose purpose is then to allow the passage of a supply of air that is suitable for cooling the chamber base itself, with the advantage that this cooling air supply is smaller than that required in the case where deflectors are used.

Nevertheless, with such a configuration it appears that the holes created produced either disruption of the combustion reactions in the primary zone or thermal discontinuities at the junctions between the chamber base and the external and internal axial walls.

OBJECT OF THE INVENTION

The purpose of the invention is therefore to propose an annular turbine engine combustion chamber, with this device remedying, at least in part, the above mentioned disadvantages associated with formerly used constructions.

More specifically, the purpose of the invention is to present an annular turbine engine combustion chamber in which the means used to cool the chamber base generate neither significant disruption of the combustion reactions inside the chamber nor thermal discontinuities at the junctions between the chamber base and the external and internal axial walls.

In order to do this, the object of the invention is an annular turbine engine combustion chamber which includes an external axial wall, an internal axial wall and a chamber base that links the axial walls, with the chamber base being equipped with a series of injection ports and a series of holes, with the injection ports capable of being used at least to inject fuel into the interior of the combustion chamber, and with the holes used to allow the passage of a supply of cooling air which is suitable for cooling the chamber base. As described in the invention, the chamber base is equipped with both an external portion in which the holes are made so that they direct part of the cooling air supply towards the external axial wall, and an internal portion in which the holes are made so that they direct another part of the cooling air supply towards the internal axial wall. The chamber is also designed so that in any axial half-section taken anywhere between two directly successive injection ports, the values of the acute angles formed between a line that is effectively a median of the half-section located between the external axial wall and the internal axial wall and the principal directions, in this half-section, of the holes in the external portion decrease as a function of the distance between the holes and this line that is effectively the median, and the acute angles formed between the line that is effectively the median and the principal directions, in this half-section, of the holes in the internal portion, decrease as a function of the distance between the holes and this line that is effectively a median.

In other words, the combustion chamber as described in the invention is such that the holes located close to a junction between the external portion and internal portion of the chamber base, that is effectively opposite a central annular crown of the combustion chamber, are more inclined towards the direction of the axial walls than the holes located close to these same axial walls, that is effectively opposite the annular crowns at the end of this combustion chamber, can be.

It is an advantage if the holes located close to the junction between the external portion and internal portion of the chamber base can therefore be highly inclined towards the axial walls, and so consequently allow cooling air from these holes to readily flow and directly along the internal surface of the chamber base, effectively radially to the internal and external axial walls. In the same manner, this high degree of possible inclination indicates that the cooling air is only slightly directed towards the centre of the primary zone of the combustion chamber, so that it does not cause any significant disruption of the combustion reactions.

In addition, the holes located close to the axial walls may be only slightly inclined towards these axial walls, so that the cooling air emerging from these holes may readily flow directly along the internal surface of these same axial walls. It is further specified that at the places in the chamber base where the cooling air may be discharged into the interior of the combustion chamber in a direction that is effectively axial to the latter, that is, effectively parallel to the axial walls, the primary zone is at a sufficient distance for the cooling air that is introduced not to cause any significant disruption of the combustion reactions.

In addition, it is also an advantage if there is progressive inclination of these holes as they get closer to the internal and external walls. This will produce a cooling flow that is effectively homogeneous over the entire internal surface of the chamber base, as well as over the entire hot internal surface of the axial walls, located close to the chamber base.

The combustion chamber as described in the invention is consequently perfectly adapted so as not to produce significant disruption of the combustion reactions inside the primary zone. This is essential for combustion chamber stability and ignition. Furthermore, the specific design of this chamber means that a satisfactory thermal continuity at the junctions between the chamber base and the internal and external axial walls is simultaneously obtained.

Preferably, for any two directly successive holes whatsoever in the external portion, the two acute angles formed between the principal directions of these holes and the line that is effectively the median will have different values, any for any two directly successive holes whatsoever in the internal portion, the two acute angles formed between the principal directions of these holes and the line that is effectively the median will have different values.

This specific configuration means that a very gradual change in the inclination of the holes in the chamber base is obtained. Naturally, different solutions could also be foreseen in which any several holes whatsoever that are directly successive would have the same inclination in the plane of the half-section concerned without departing from the context of the invention.

The chamber base would preferably be equipped with primary sectors of holes and secondary sectors of holes, with the primary sectors being effectively located between two directly successive injection ports and the secondary sectors being located on each side of each injection port, in a direction that is effectively radial to the combustion chamber.

It is possible with such an arrangement to further enhance the homogeneity of the cooling air supply that is being directed towards the external and internal axial walls of the combustion chamber. In particular such homogeneity can be obtained by arranging for the holes in the secondary sector to be of larger dimensions than those in the primary sectors due to their being present in slightly greater numbers.

Other advantages and characteristics of the invention will appear in the detailed non-restrictive description below.

BRIEF DESCRIPTION OF THE DRAWINGS

This description will be made in relation to the appended drawings, amongst which are.

DETAILED DESCRIPTION OF A PREFERRED EMBODIMENT

Figure 1:
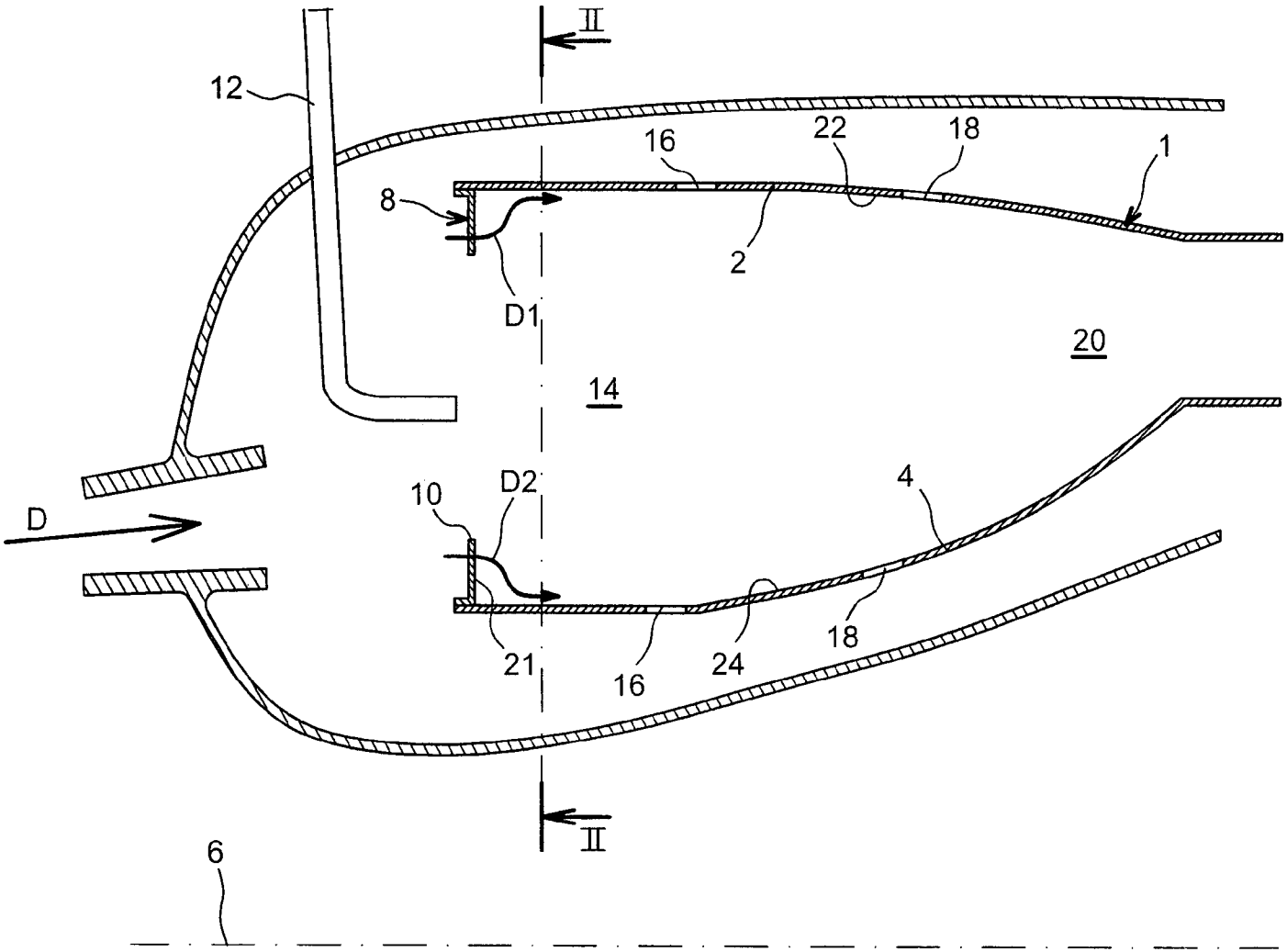
FIG. 1, which represents a partial axial cross-sectional view of an annular combustion chamber of a turbine engine that is in accordance with a preferred method of construction for the present invention, FIG. 2, which represents a partial cross-sectional view along line II-II of FIG. 1, FIG. 3, which represents a cross-sectional view along line III-III of FIG. 2, and FIG. 4, which represents a cross-sectional view along line IV-IV of FIG. 2.
Figure 2:
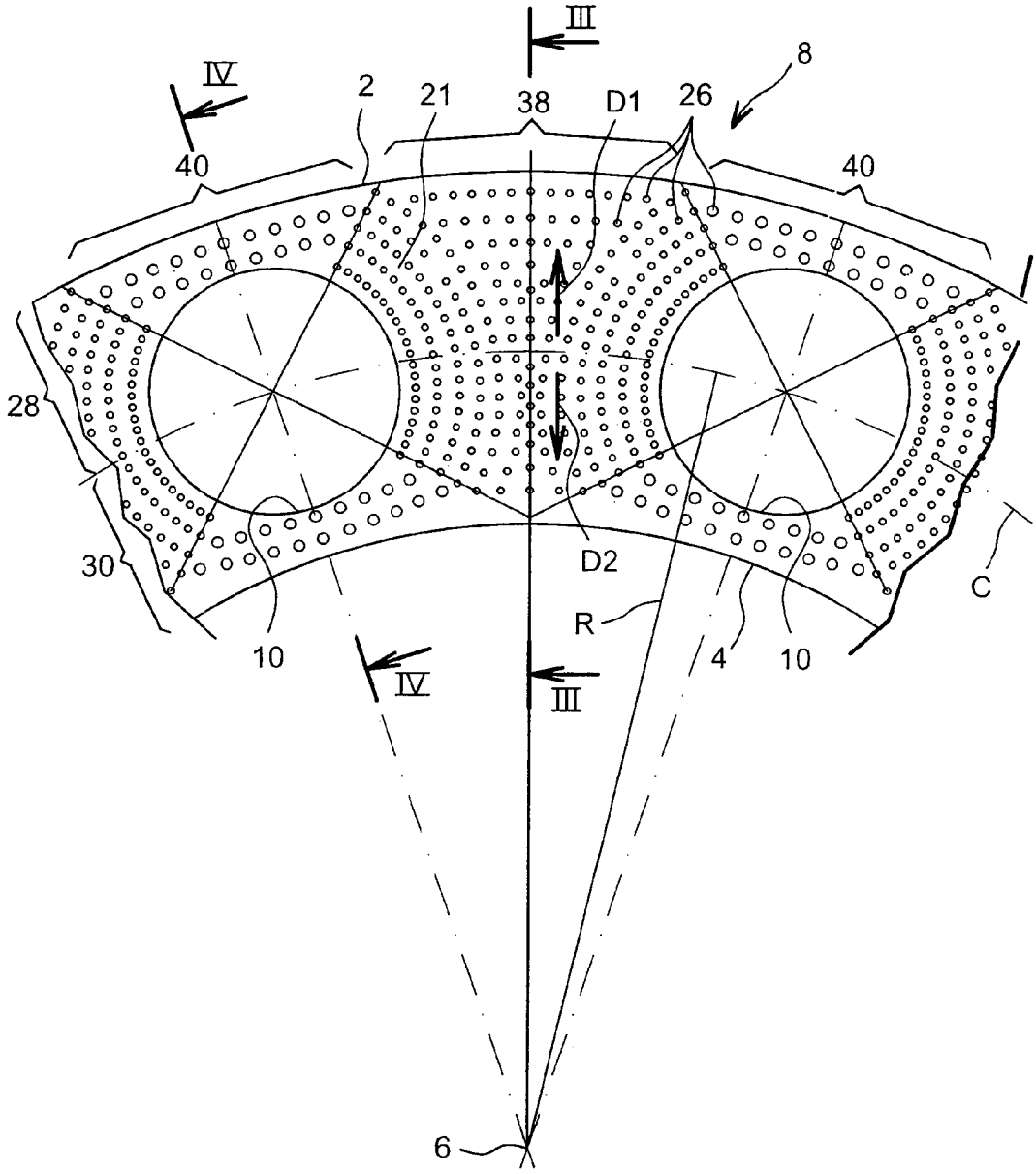

With reference to both FIGS. 1 and 2, an annular combustion chamber 1 of a turbine engine is represented that is in accordance with a preferred embodiement of the present invention.

The combustion chamber 1 includes an external axial wall 2 and an internal axial wall 4, with both theses walls 2 and 4 being arranged coaxially along a principal longitudinal axis 6 of chamber 1 and where this axis 6 also corresponds to the principal longitudinal axis of the turbine engine.

Axial walls 2 and 4 are connected together by a chamber base 8, with this being assembled, for example, by being welded to an initial part of each of axial walls 2 and 4.

The chamber base 8 preferably takes the form of an annular crown, which is effectively flat, with an axis which is the same as the principal longitudinal axis 6 of the chamber 1. Naturally, this chamber base 8 could also have any other appropriate shape, such as a tapered form along the same axis without departing from the context of the invention.

A series of injection ports 10, preferably of cylindrical form and circular section, are arranged at an angle and in an effectively regular manner at the chamber base 8. Each injection port 10 is designed so that it can fit with a fuel injector 12 in order to allow combustion reactions to take place inside this combustion chamber 1. It is specified that these injectors 12 are also designed so that they are used to introduce at least part of the air to be used in combustion, with combustion taking place in a primary zone 14 located in a first part of the combustion chamber 1. Furthermore, it is also stated-that the air to be used for combustion may also be introduced to the interior of the chamber 1 through primary ports 16, located all around the external 2 and internal 4 axial walls. As can be seen in FIG. 1, the primary ports 16 are arranged before a series of dilution ports 18. These dilution ports are also located all around the external 2 and internal 4 axial walls and their main function is to supply air to a dilution zone 20 located after the primary zone 14.

Furthermore, it is specified that another portion of the air brought into to the combustion chamber 1 is in the form of a supply of cooling air D, whose principal function is to cool the internal surface 21 of the chamber base 8. In this respect, although the air used to cool the chamber base 8 is also used to cool an initial part of internal surfaces 22 and 24 of external 2 and internal 4 axial walls, an additional supply of cooling air (not shown) is generally provided to cool all the hot internal surfaces 22 and 24.

More specifically, in reference to FIG. 2, it may be seen that the chamber base 8 is multi-holed, namely, it possesses a series of holes 26, preferably cylindrical and of circular cross-section, which are used to allow a supply of cooling air D to pass into the interior of combustion chamber 1.

As can be seen in this figure, the chamber base 8 is divided into an external portion 28 connected to the external axial wall 2 and an internal portion 30 connected to internal axial wall 4. Naturally, these annular portions 28 and 30 are usually formed from a single piece, and their virtual separation therefore consists of a circle C whose centre is located on the principal longitudinal axis 6, and whose radius R corresponds to an average radius between the external radius and internal radius of the chamber base 8.

The holes 26 located on the external portion 28 are therefore made in such a manner in chamber base 8 that they direct a portion D1 of the cooling air supply D towards the external axial wall 2 in order to cool all of external part 28, as well as an initial part of axial external wall 2. In the same way, the holes 26 located on the internal portion 30 are made so that they direct another portion D2 of the cooling air supply D towards internal axial wall 4, in order to cool the entire internal portion 30, as well as an initial part of internal axial wall 4.

Figure 3:
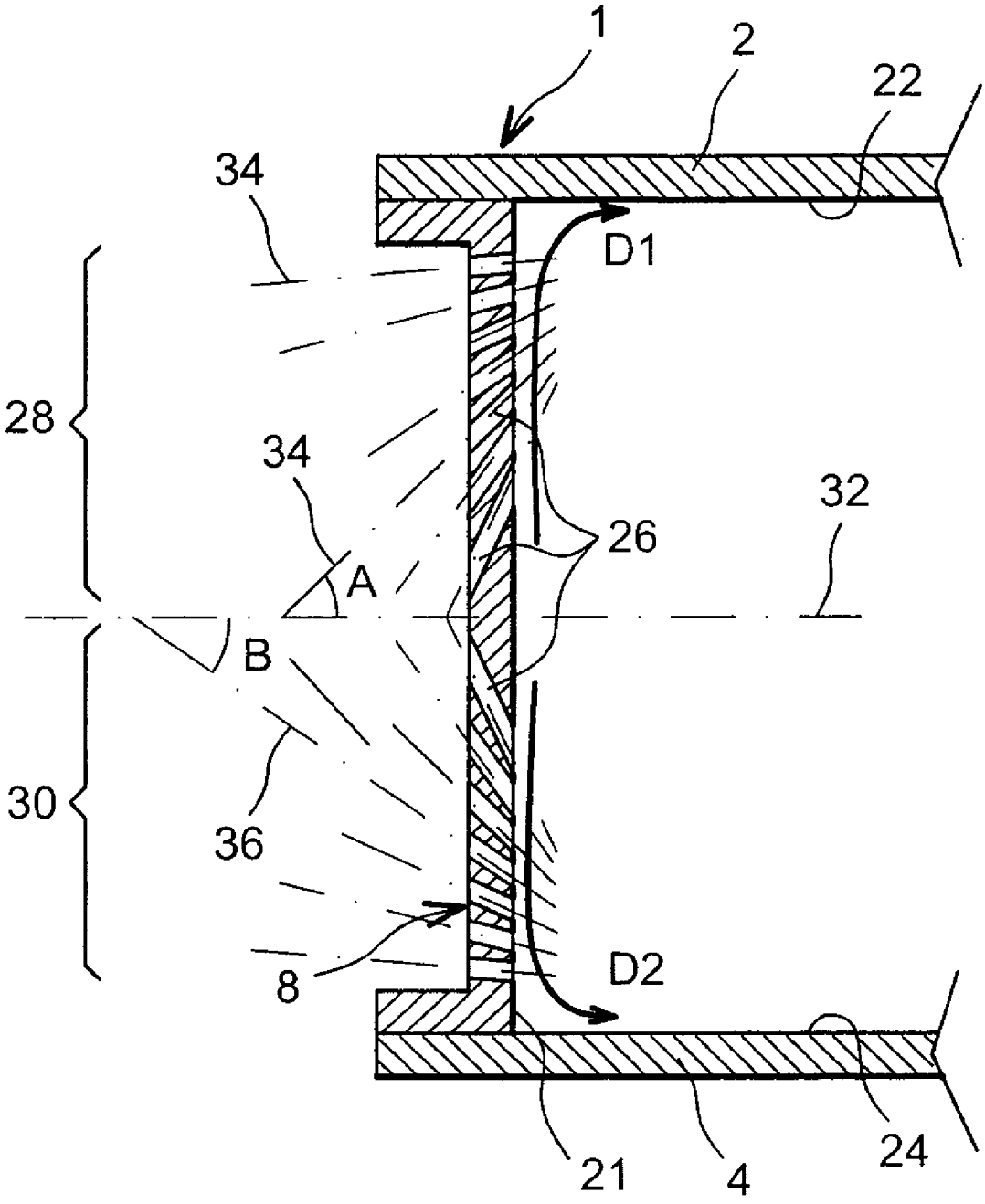

Now with reference to FIG. 3, it can be observed that in the axial cross section, the holes 26 in the external portion 28 are such that the value of the acute angles A formed between a line which is effectively the median 32 of the half-section and the principal directions 34 of the holes 26 in this half-section decrease as a function of the distance between these holes 26 and the line that is effectively the median 32.

In other words, in each axial half-section of the combustion chamber 1, taken between any two directly successive injection ports 10 whatsoever, the inclination of the holes 26 in relation to the external axial wall 2 gradually decreases as these holes 26 become further from the line that is effectively the median 32, with this line being primarily mentioned as a reference.

This means that the line that is effectively the median 32 naturally refers to a virtual line located at approximately equal distances from the initial parts of external 2 and internal 4 axial walls considered in half-section. It should also be noted in this sense that in addition to the fact that it constitutes an axis of symmetry for the half section shown, line 32 is a virtual separation line between external portions 28 and internal portions 30 of the chamber base 8.

It is specified that in the preferred method of construction described, this line that is effectively the median 32, which passes through circle C is also effectively perpendicular to the chamber base 8, insofar as it is itself effectively perpendicular to axial walls 2 and 4.

On the other hand, it is also stated that in the axial half-section shown in FIG. 3, the principal directions 34 of holes 26 correspond respectively to their principal axes, in the direction that these holes 26 are all diametrically traversed by the plane of the section. However, in all other axial half-sections where one or more holes 26 may be sectioned other than diametrically, each principal direction 34 may then be considered as being a line that is effectively parallel to the two line segments which represent the hole 26 that is involved.

Thus the holes 26 located close to the line which is effectively the median 32 may therefore be highly inclined so that, for example, the acute angle A attains a value of about 60°. The cooling air emerging from these holes 26 can as a consequence readily flow directly along the interior surface 21 of the external part 28 of the chamber base 8, and in an effectively radial manner up to the external axial wall 2, without disturbing the combustion reactions in primary zone 14.

Furthermore the holes 26 located close to axial external wall 2 may be only slightly inclined towards this wall 2, so that, for example, the acute angle A reaches a value of about 5°. The cooling air emerging from these holes 26 can therefore readily flow directly along the interior hot surface 22 of the external axial wall 2 without stagnating at the junction between the chamber base 8 and this axial wall 2.

By specifying a value for the acute angle A which progressively decreases as the external axial wall 2 is approached, it is therefore possible to obtain a highly homogeneous proportion D1 of the cooling flow D which does not create thermal discontinuities at the various constituents of the combustion chamber 1.

In the same manner and with the aim of taking advantage of the same effects over an internal portion 30 of chamber base 8 as well as over internal axial wall 4, in axial half section, the holes 26 in the internal portion 30 are such that the values of the acute angles B formed between the line that is effectively the median 32 and the principal directions 36 of the holes 26 in this half-section, decrease as a function of the distance between these holes 26 and this line which is effectively the median 32.

In a similar manner to that encountered with the external portion 28 of the chamber base 8, the value of the acute angles B formed between on one hand the principal directions 36 of the holes 26 in the internal portion 30 and on the other hand the line that is effectively the median 32, may gradually change from about 60° to about 5° as the internal axial wall 4 is approached.

Referring once again to FIG. 2, it can be seen that the chamber base 8 is equipped with primary sectors 38 with holes 26, with these primary sectors 38 being effectively located between two directly successive injector ports 10. As may be seen in this figure, at least some of the holes 26 in each primary sector 38 (only one of these is shown) are arranged so as to define the rows which take the form of curved lines centred on the centre of injection port 10, close to which these holes 26 are located.

In addition, the chamber base 8 is also equipped with secondary sectors 40 with holes 26, with these secondary sectors 40 each being located between two successive primary sectors 38 on either side of an injection port 10 in a direction that is effectively radial to the combustion chamber 1.

In other words, in this direction that is effectively radial to combustion chamber 1, a secondary sector 40 is located both above and below the injection port 10 concerned.

Figure 4:
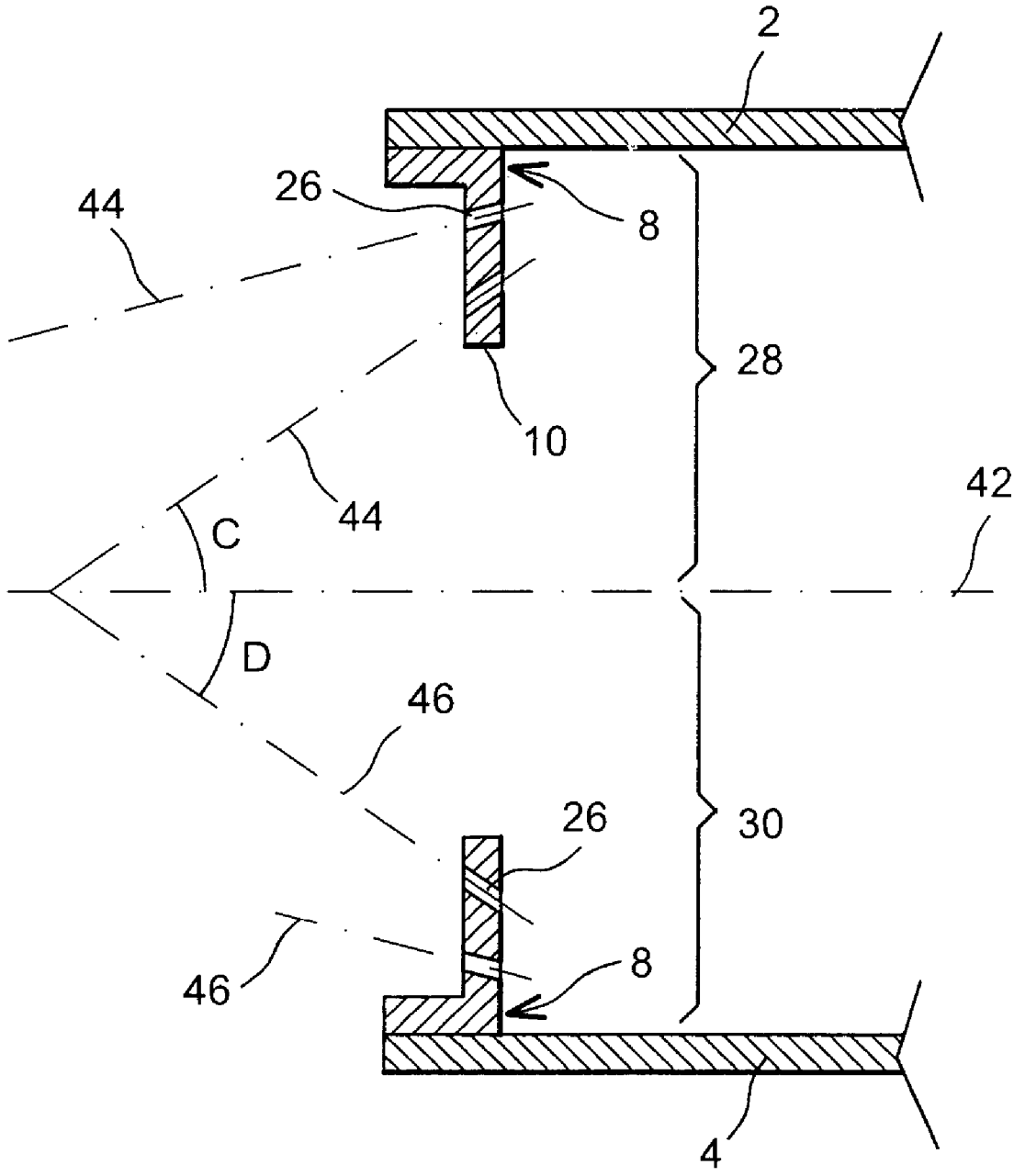

In this respect, as shown in FIG. 4 and in a similar manner to that described above, it can also be arranged so that in an axial half-section taken so as to pass through an injection port 10, holes 26 in the external portion 28 as such that the values of the acute angles C formed between a line that is effectively the median 42 of the half-section and the principal directions 44 of the holes 26 in this half-section decrease as a function of the distance of the holes 26 from this line that is effectively the median 42.

In the same manner, the holes 26 in the internal portion 28 are such, therefore, that the values of the acute angles D formed between the line that is effectively the median 42 of the half-section and the principal directions 46 of the holes 26 in this half-section decrease as a function of the distance between these holes 26 and this line that is effectively the median 42.

Finally, it is specified that in order for the portions D1 and D2 of the flow to be as circumferentially homogeneous as possible, the holes 26 in secondary sectors 38 are preferably of larger dimensions than those of holes 26 in primary sector 40, on the grounds that they are present in smaller numbers.

Naturally, various modifications can be made by professionals working in this field to the annular combustion chamber 1 that has just been described as a non-restrictive example only.

The invention claimed is:

1. An annular turbine engine combustion chamber, comprising:

an external axial wall;

an internal axial wall; and a chamber base that links said external and internal axial walls, with the chamber base possessing a series of injection ports and a series of holes with said injection ports configured to at least allow injection of fuel into an interior of the combustion chamber and said holes configured to allow a supply of cooling air to pass for cooling the chamber base, wherein the chamber base is equipped with an external portion in which the holes are made to direct a first part of the supply of cooling air towards the external axial wall and an internal part in which the holes are made to direct a second part of the supply of cooling air towards the internal axial wall, and wherein the chamber is configured so that in an axial half-section, taken in any manner whatsoever between two directly successive injection ports, (1) values of first acute angles formed between a line that is effectively a median of the half-section located between the external axial wall and the internal axial wall and principal directions, in this half-section, of the holes of the external portion, decreases as a function of a distance between the holes and this line that is effectively the median, and (2) values of the second acute angles formed between the line that is effectively the median and the principal directions, in this half-section, of the holes in the internal portion, decrease as a function of the distance between the holes and the line that is effectively the median.

2. An annular combustion chamber as described in claim 1, wherein for any two directly successive holes whatsoever in the external portion, two first acute angles formed between the principal directions of these holes and the line that is effectively the median will have different values, and wherein for two any two directly successive holes whatsoever in the internal portion, two second acute angles formed between the principal directions of these holes and the line that is effectively the median will have different values.

3. An annular combustion chamber as described in claim 1, wherein the chamber base is equipped with primary sectors of holes and with secondary sectors of holes, with the primary sectors being effectively located between two directly successive injection ports and the secondary sectors being located on either side of each injection port, in a direction that is effectively radial to the combustion chamber.

4. An annular combustion chamber as described in claim 2, wherein the chamber base is equipped with primary sectors of holes and with secondary sectors of holes, with the primary sectors being effectively located between two directly successive injection ports and the secondary sectors being located on either side of each injection port, in a direction that is effectively radial to the combustion chamber.

5. An annular combustion chamber as described in claim 3, wherein the holes in the secondary sectors are of larger dimensions than those of the holes in the primary sectors.

6. An annular combustion chamber as described in claim 4, wherein the chamber base is equipped with primary sectors of holes and with secondary sectors of holes, with the primary sectors being effectively located between two directly successive injection ports and the secondary sectors being located on either side of each injection port, in a direction that is effectively radial to the combustion chamber.

* * * * *